United States Patent [19]

Ebner

[11] 4,046,372

[45] Sept. 6, 1977

[54] PHOTOTYPESETTER FILM FEED DEVICE

[75] Inventor: Peter R. Ebner, Nashua, NH

[73] Assignee: Itek Corporation, Lexington, Mass.

[21] Appl. No.: 711,657

[22] Filed: Aug. 4, 1976

[51] Int. Cl.[2] ..... B65H 29/20

[52] U.S. Cl. ..... 271/273; 226/90

[58] Field of Search ..... 271/272–274; 226/89–91, 190; 198/624, 835

[56] References Cited

U.S. PATENT DOCUMENTS

| | | | |
|---|---|---|---|
| 2,841,298 | 7/1958 | Walsh et al. | 198/624 |
| 3,330,458 | 7/1967 | Bentzman | 226/90 |

*Primary Examiner*—Robert W. Saifer

*Attorney, Agent, or Firm*—Homer O. Blair; Robert L. Nathans; Gerald H. Glanzman

[57] ABSTRACT

Film transport apparatus for phototypesetters. The apparatus includes upper and lower guide plates supporting pinch and drive rollers, respectively, between which a strip of film is frictionally fed. A pair of hold-down rollers are provided to press the upper guide plate against the lower guide plate to maintain the pinch and drive rollers properly positioned against each other, and also to help keep the apparatus locked together during operation. The upper guide plate is designed to be laterally slidable relative to the lower guide and further is provided with a pair of notches cut into its sides. Accordingly, to load film into the apparatus, it is only necessary to slide the upper guide plate until the hold-down rollers become aligned with the notches at which position the upper guide plate can be lifted up and away from the lower guide plate to separate the pinch and drive rollers for film loading.

The apparatus can thereafter be reassembled by lowering the upper guide plate and sliding it back in the opposite direction until the hold-down rollers again engage the plate. Means are additionally provided to adjust the clearance between the upper and lower guide plates by adjusting the position of the hold-down rollers.

The system so provided avoids the need for hold-down screws or other more complex securing techniques and permits rapid and easy film loading with a minimum of machine down-time.

7 Claims, 3 Drawing Figures

PHOTOTYPESETTER FILM FEED DEVICE

BACKGROUND OF THE INVENTION

1. Field of the Invention

The present invention relates generally to a film handling mechanism and, more particularly, to a film feeding apparatus for phototypesetters designed to allow the operator to load film more quickly and easily.

2. Description of the Prior Art

Phototypesetting machines frequently utilize a friction drive technique to advance film in the film transport. In many such systems, the combination of a drive roller and a pinch roller are used. Specifically, the drive and pinch rollers are supported adjacent one another and the film is frictionally driven between them.

In most such transports, it is necessary to separate the two rollers in order to load or reload film into the system. This, in turn, necessitates separation of upper and lower guide plates by which the pinch and drive rollers, respectively, are supported. In the prior art, this typically necessitates the removal of several screws, the lifting off of the upper plate and, after loading of the film, the replacement of the upper plate and the proper reinsertion of the several screws. It is desirable to simplify this loading procedure so as to permit film to be loaded into the film transport much quicker and easier with a minimum of machine down-time.

SUMMARY OF THE PREFERRED EMBODIMENT

In accordance with the present invention, a novel film transport system has been provided which allows the phototypesetter operator to load film quickly and easily without the necessity of removing screws and the like. In accordance with the preferred embodiment, the upper and lower guide plates are mounted to be slidable relative to one another such that when it becomes necessary to load or reload film, it is only necessary to slide the upper plate relative to the lower plate in one direction by a short distance until notches in the upper plate line up with a pair of hold-down rollers. In this position, the upper plate can be lifted up and away from the lower plate to separate the pinch and drive rollers for film loading. After loading, the upper plate is simply replaced and slid back in the opposite direction into a locking position. When the upper guide plate is in a locked position, the pair of hold-down rollers will hold the two plates together and also apply the proper force to cause friction between the pinch and drive rollers.

With the present invention, film can be loaded into the transport system rapidly and easily with a minimum of machine down-time. Further details and advantages of the invention will be set forth hereinafter in conjunction with the detailed description of the most preferred embodiment.

DETAILED DESCRIPTION OF THE PREFERRED EMBODIMENT

Figure 1:
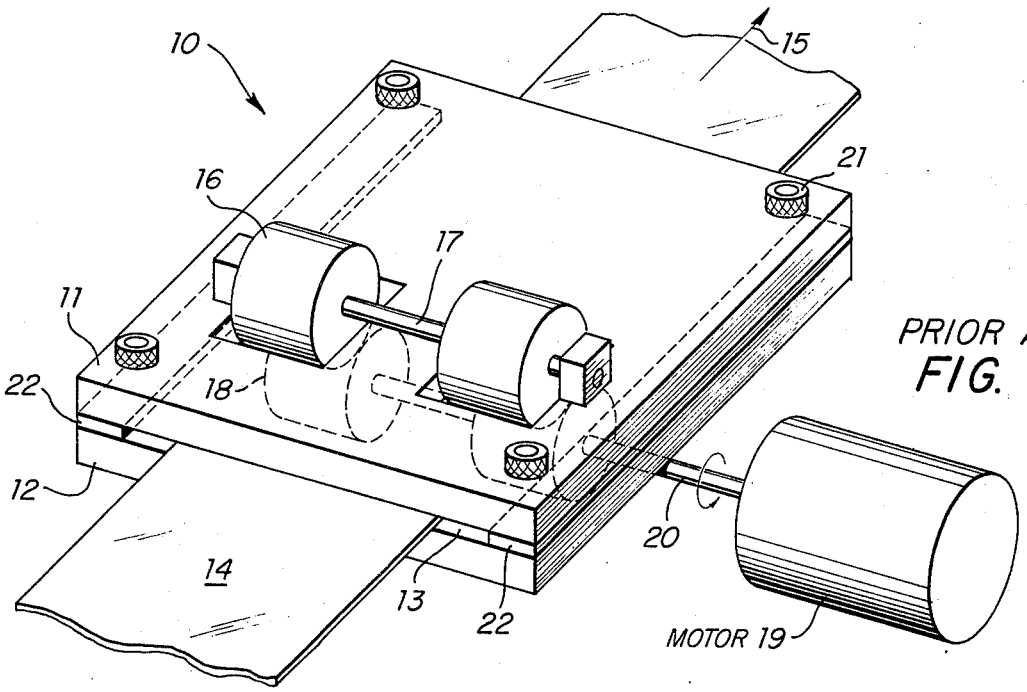
PRIOR ART FIG. 1.
FIG. 1 illustrates, in somewhat schematic plan view, a film transport mechanism as is typically found in the prior art.

FIG. 1 illustrates a film transport mechanism for phototypesetting machines typical of those that are presently employed in the prior art. As shown, the transport, generally identified by reference number 10, includes an upper guide plate 11 and a lower guide plate 12 spaced apart in substantially parallel relationship by shims 22 which are bonded to upper plate 11 so as to define a narrow gap or spacing 13 therebetween through which film 14 is to be transported in the direction indicated by arrow 15. More particularly, upper guide plate 11 is adapted to support a pair of pinch rollers 16 freely rotatable on shaft 17 while lower guide plate 12 is adapted to support a pair of drive rollers 18 (shown in dotted line) which are driven into rotation by drive motor 19 through drive shaft 20. The film itself is supported between the rollers 16 and 18 and is adapted to be frictionally fed through the transport at a rate determined by the speed of rotation of drive rollers 18.

In order to ensure that the film is driven through the transport smoothly and at the precise distance desired, it is of course, necessary that the force between the drive rollers and the pinch rollers be maintained constant and precise. Accordingly, it is essential that the upper and lower guide plates be fastened to one another securely so as to hold the drive and pinch rollers together. In the FIG. 1 embodiment, this is accomplished by securing the two plates together with four hold-down screws 21 mounted at the four corners of the plates.

In order to load film into the transport system, it is necessary to remove the upper guide plate to separate the rollers. This necessitates unscrewing of the four screws 21 and removal of the upper plate. Film can then be properly loaded into the mechanism, the upper guide plate positioned and the screws reinserted. This is somewhat of a time consuming operation during which time the typesetting machine cannot be used.

Figure 2:
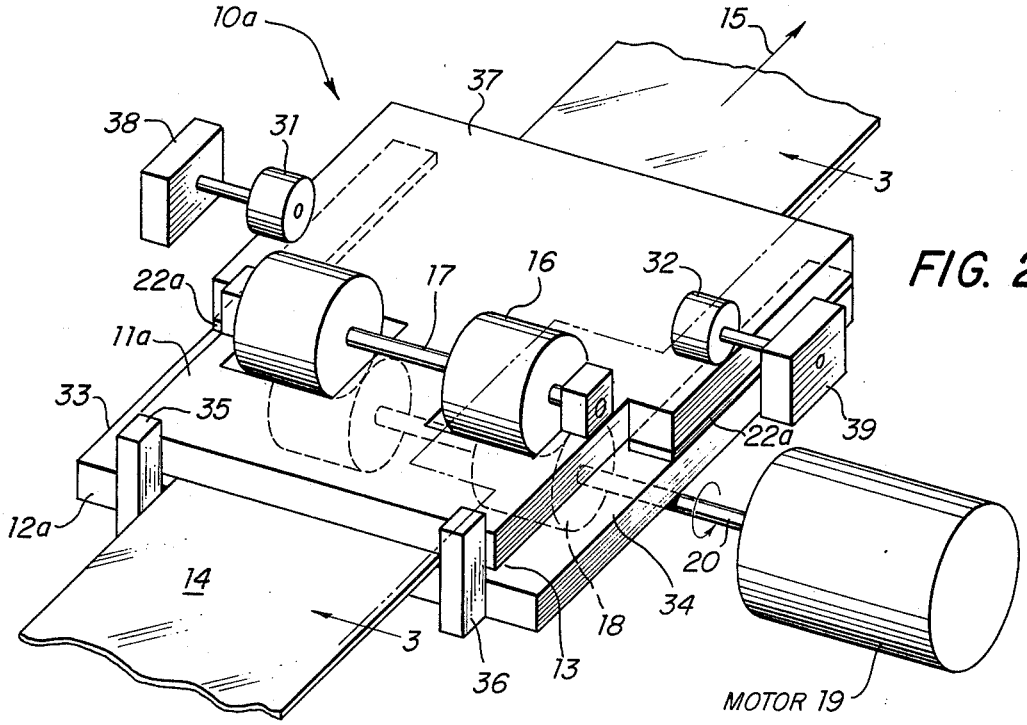
FIG. 2 illustrates, in somewhat schematic plan view, a film transport according to the presently most preferred embodiment of the present invention.
Figure 3:
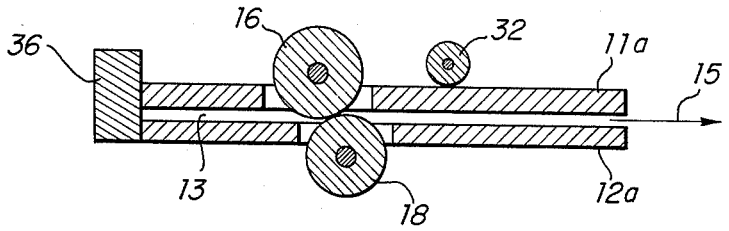
FIG. 3 schematically illustrates a cross-section view of the transport of FIG. 2 looking in the direction of arrow 3—3 in FIG. 2.

A simpler and more readily operable technique for loading film has been provided by the present invention as described more completely in FIGS. 2 and 3. In FIG. 2, the film transport 10*a*, according to a presently most preferred embodiment, includes an upper guide plate 11*a* for supporting a pair of pinch rollers 16 on shaft 17, and a lower guide plate 12*a* for supporting a pair of drive rollers 18 driven by motor 19 via drive shaft 20 as described in connection with the FIG. 1 embodiment. Also, as in FIG. 1 embodiment, film 14 is adapted to be frictionally driven through transport 10a between rollers 16 and 18 in the direction indicated by arrow 15. The system of FIG. 2 differs from that of FIG. 1, however, in the following respects. Initially, the hold-down screws have been eliminated and replaced by a pair of hold-down rollers 31 and 32 adapted to press down upon upper or outer surface 37 of upper guide plate 11*a*. Additionally, upper guide plate 11*a* is designed to have a pair of indentations or notches 33 and 34 cut into each side thereof as illustrated. Finally, a pair of stops 35 and 36 are secured to the lower guide plate 12*a* to limit movement of the upper guide plate 11*a* relative to it.

The mechanism operates as follows. During normal operation, the system is in the position illustrated in FIG. 2. The upper and lower guide plate 11*a* and 12*a* are aligned relative to one another such that pinch rollers 16 and drive rollers 18 are against one another (although slightly off-center as will be explained hereinafter) with hold-down rollers 31 and 32 pressing down upon upper guide plate 11*a* to hold the drive and pinch rollers together. For loading or reloading film into the system, it is only necessary to slide upper guide plate 11*a* in the direction illustrated by arrow 15 a short distance until the hold-down rollers 31 and 32 line up with the notches 33 and 34, respectively. This will release the upper guide plate and allow it to be lifted up and away from the lower guide plate to separate the pinch and drive rollers for loading. After film loading, the upper guide plate can be replaced merely by laying it back on top of the lower guide plate and then sliding it back in the direction opposite arrow 15 until it comes into contact with stops 35 and 36 as illustrated. In this position, hold-down rollers 31 and 32 will again engage the upper surface 37 of upper guide plate 11*a* to press the plates and hence, the rollers, together for use.

FIG. 3 illustrates the relationship between the pinch and drive rollers in their operating position. As shown, they are not directly one on top of the other, but, instead, are slightly off-center relative to one another. This provides a detenting action which prevents the upper plate from accidentally moving in the direction of arrow 15 to a release position.

Also, as illustrated in FIG. 2, adjustment means 38 and 39 are coupled to the hold-down rollers 31 and 32, respectively. These are provided so that the hold-down rollers can be adjusted as to the amount of clearance between the upper guide plate and lower guide plate so as to set the clearance for the film.

In summary, the present invention enables very rapid and easy film loading of the film transport without the need for unscrewing bolts or the like. While the present invention has been described primarily as a film feed device for phototypesetters, it should be evident that it has application in a wide variety of other fields wherein a film or any form of continuous or specific length of sheet is to be fed. Accordingly, it should be understood that the invention should be limited only insofar as required by the scope of the following claims.

What is claimed is:

1. Sheet feeding apparatus comprising:

a. first and second guide means for defining a passageway therebetween through which a sheet is to be fed, said first and second guide means including first and second roller means, respectively, between which said sheet is to be passed for driving said sheet through said passageway, said first guide means comprising first guide plate means having an outer surface; and, b. means for releasably securing said first and second guide means, said releasable securing means including:

1. hold-down means for pressing against said outer surface of said first guide plate means to press said first guide plate means toward said second guide means; and,
2. means for supporting said first guide plate means for lateral movement between a first position wherein said hold-down means is pressing against said outer surface of said first guide plate means for pressing said first guide plate means toward said second guide means for operation, and a second release position wherein said hold-down means is displaced from said outer surface of said first guide plate means whereby said first and second guide means may be separated from one another for loading said sheet into said apparatus.

2. Apparatus as recited in claim 1 wherein said first guide plate means includes notch means formed therein, said notch means being normally displaced from said hold-down means when said first guide plate means is in said first position and in alignment with said hold-down means when said first guide plate means is in said second position whereby said first guide plate means may be lifted up and away from said second guide means.

3. Apparatus as recited in claim 2 wherein said first and second roller means are slightly off-center relative to one another in said first position whereby said first roller means provides a detenting action to prevent said guide means from laterally sliding to said second position.

4. Apparatus as recited in claim 1 wherein said hold-down means comprises hold-down roller means.

5. Apparatus as recited in claim 1 and further including means for driving said second roller means for driving said sheet between said first and second roller means and, hence, through said passageway.

6. Apparatus as recited in claim 1 and further including stop means for limiting lateral movement of said first guide plate means.

7. Apparatus as recited in claim 1 wherein said first and second roller means are slightly off-center relative to one another in said first position whereby said first roller means provides a detenting action to prevent said first guide plate means from laterally sliding to said second position.

* * * * *